United States Patent [19]

Yamada

[11] Patent Number: 4,534,564

[45] Date of Patent: Aug. 13, 1985

[54] GOLF CLUB HEAD

[75] Inventor: Magoichi Yamada, Tokyo, Japan

[73] Assignee: Daiwa Golf Co., Ltd., Kurume, Japan

[21] Appl. No.: 515,379

[22] Filed: Jul. 18, 1983

[30] Foreign Application Priority Data

Jul. 21, 1982 [JP] Japan ..... 57-110398[U]

[51] Int. Cl.[3] ..... A63B 53/04

[52] U.S. Cl. ..... 273/169; 273/167 H

[58] Field of Search ..... 273/169, 167 H, 170, 273/171, 172, 173, 174, 167 F

[56] References Cited

U.S. PATENT DOCUMENTS

| | | | |
|---|---|---|---|
| 1,673,973 | 6/1928 | Drevitson | 273/167 F |
| 2,486,952 | 11/1949 | Kearsley et al. | 273/169 X |
| 3,140,094 | 7/1964 | Hings | 273/80.3 |
| 3,356,782 | 12/1967 | Whyte | 273/171 X |
| 3,556,532 | 1/1971 | Ballmer | 273/169 X |

FOREIGN PATENT DOCUMENTS

| | | | |
|---|---|---|---|
| 19688 | of 1897 | United Kingdom | 273/169 |
| 380260 | 9/1932 | United Kingdom | 273/169 |
| 488469 | 7/1938 | United Kingdom | 273/169 |

*Primary Examiner*—George J. Marlo
*Attorney, Agent, or Firm*—Fred Flam

[57] ABSTRACT

A golf club driver head made from a plastic such as nylon is provided with a sole plate covering a cavity of a predetermined size and depth including a blind bore devoid of any weighting material extending from the inner end of the cavity towards the toe whereby the mass of the head is distributed for dynamic balance.

1 Claim, 5 Drawing Figures

GOLF CLUB HEAD

FIELD OF INVENTION

The present device relates to a golf club head and, more particularly, to a golf club head made of plastic and of the type generally referred to as "wood" or "driver".

BACKGROUND OF THE INVENTION

In recent years, synthetic resinous materials such as those mainly consisting of nylon, ABS resin and so forth are becoming popular as the materials for the golf club heads, particularly the heads of clubs called "wood", "driver" and "spoon", besides the natural wood material such as persimmon, cherry and so forth. Usually, the golf club head of a synthetic resin is formed integrally by means of a pair of split mold elements. Therefore, certain problems are encountered in the reduction of weight and weight balancing of the head body, if the size and weight of the club head of a plastic are selected to be equal to those of wooden club heads, and if a sole plate is used to prevent the damage of the sole plate and to obtain the balance of weight so as to attain performance and characteristics equivalent to those of the wooden club heads. The prior art deals with the formation of an internal hollow for the golf club head, and includes U.S. Pat. No. 3,556,532 to James E. Ballmer, dated Jan. 19, 1971, entitled PLASTIC GOLF CLUB HEAD WITH CAVITIES THEREIN TO SOUND LIKE A WOODEN CLUB HEAD, and U.S. Pat. No. 3,140,094 to Donald P. Hings, dated July 7, 1964, entitled EPOXY RESIN GOLF CLUB HEAD INTEGRALLY CURED WITH A SHAFT WRAPPING OF GLASS FIBER MATERIAL.

It has been proposed to adopt a hollow structure of the golf club head in order to reduce the weight of the same. This, however, imposes the following problems. Namely, for attaching a sole plate as in the case of the wooden club heads, the position of the hollow tends to be offset with respect to the head body because of the necessity of the mounting space for mounting the sole plate, resulting in an unbalance of weight of the head body. The weight unbalance of the head body inconveniently produces a moment of inertia at the time of impact to make it difficult to control the direction of flight of the ball. Particularly, in the golf club mounting a sole plate, the hollow can be formed only in one portion of the club head under the sole plate so that the weight center of the club head is shifted undesirably towards the toe portion to produce a moment of inertia in the head body. In addition, the "sweet spot" is restricted undesirably to make the golf club difficult to use.

SUMMARY OF INVENTION

In view of the foregoing circumstances, the present device aims at providing a golf club head having various advantages such as easiness of reduction of weight of the head by the formation of an internal hollow, facilitation of formation of hollow with good balance of weight despite the mounting of a sole plate, wide sweet spot and easiness of use.

To this end, according to the device there is provided a golf club head comprising a club head body composed of a face portion, top portion, sole portion with a step for mounting a sole plate, toe portion, heel portion, back portion and a neck, wherein the club head body being provided with a hollow having a predetermined depth from the end surface of the sole portion towards the top portion and extending from the center of said sole portion towards the back portion and the face portion, and a transverse bore extending from the hollow towards the toe portion, the hollow and the transverse bore serving to distribute the mass or weight of the head to the peripheral portion of the head.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF THE PREFERRED EMBODIMENT

Figure 1:
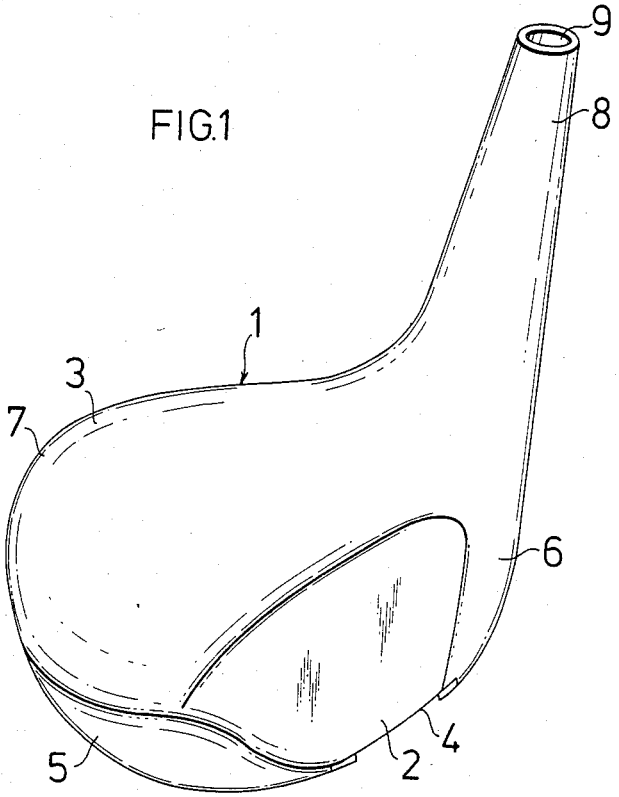
FIG. 1 is a perspective view showing the appearance of a golf club head incorporating the present invention.

The following detailed description is of the best presently contemplated mode of carrying out the invention. This description is not to be taken in a limiting sense, but is made merely for purposes of illustrating the general principles of the invention, since the scope of the invention is best defined by the appended claims.

Referring to FIGS. 1 to 5 showing a golf club head in accordance with the present invention, a club head body 1 made from a plastic has a face portion 2, top portion 3, sole portion 4, toe portion 5, heel portion 6 and a back portion 7. A neck or socket 8 projects obliquely upwardly from the heel portion 6. The neck 8 is provided with a concentric shaft insertion hole 9 for securing a shaft which is not shown. The material of the club head body 1 having the described construction is a composite material consisting mainly of a synthetic resinous material such as polycarbonate, ABS resin or NYLON 66, containing 20 to 30 wt % of reinforcement fibers such as carbon fibers, glass fibers and so forth of lengths ranging between 0.1 to 1 mm, and diameters ranging between 7 and 8 microns. Such resins are made by Mitsubishi Rayon Co., Ltd. This composite material is molten and charged by an injection device into a split mold having a mold cavity of a configuration complementary to the shape of the club head, and is solidified in the mold to become the club head.

Figure 2:
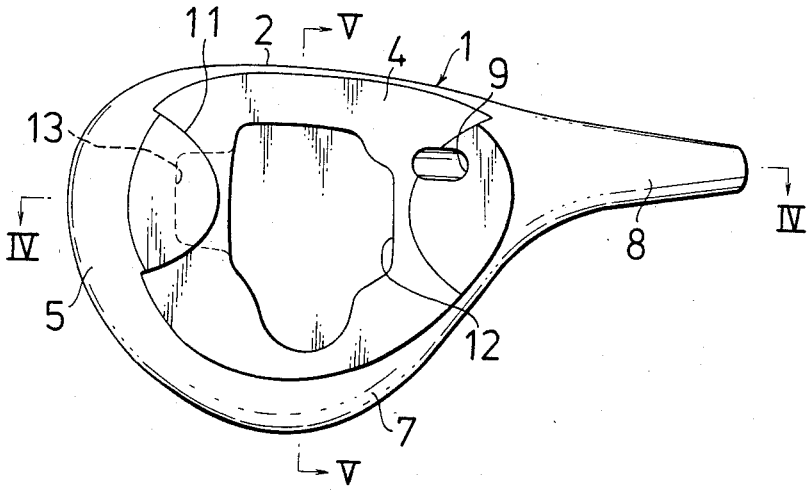
FIG. 2 is a bottom plan view of the golf club head as viewed from the sole side.
Figure 3:
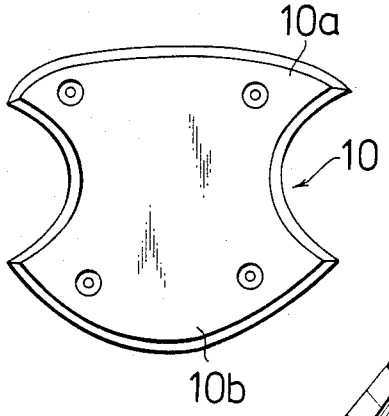
FIG. 3 is a plan view of the sole plate.
Figure 4:
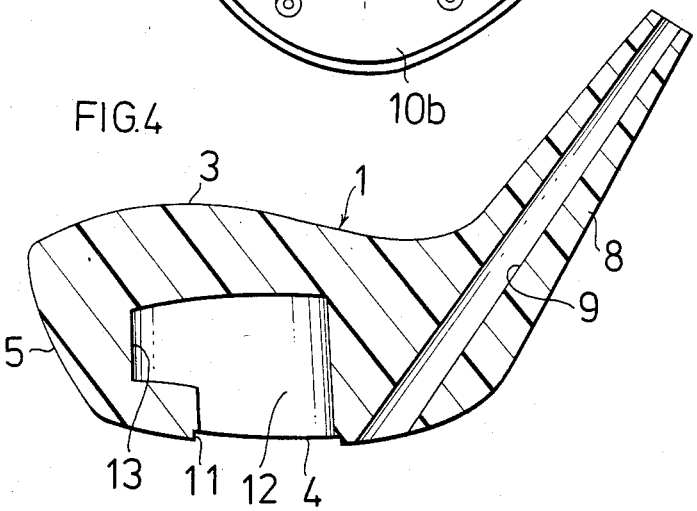
FIG. 4 is a sectional view taken along the offset plane corresponding to line IV—IV of FIG. 2.
Figure 5:
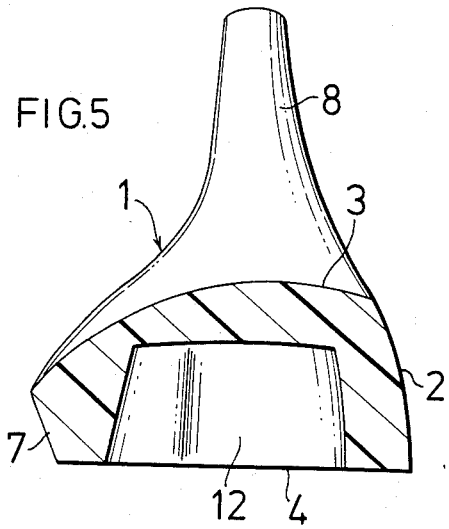
FIG. 5 is a sectional view taken along the plane corresponding to line V—V of FIG. 2.

As shown in FIGS. 2 and 3, the surface of the sole portion 4 of the club head body 1 is provided with a step 11 having a configuration coinciding with that of a sole plate 10, for mounting the latter on the sole portion 4. As will be seen from FIGS. 2, 4 and 5, a hollow 12 of a recess having a predetermined depth from the end surface of the sole portion 4 towards the top portion 3 is formed in the central portion of the sole portion 4 to be covered by the sole plate 10. The shape or configuration of the cavity or hollow 12 is so selected that the masses of the face portion 2, heel portion 6, and the back portion 7, are balanced. In addition, an undercut or transverse bore 13 is formed to extend from the innermost portion of the hollow 12 towards the toe portion 5 of the club head 1, as will be seen from FIG. 4. The transverse bore 13 forms an overhang and is effective in providing a balance between the mass around the toe 5 and the masses around the face portion 2, heel portion 6 and back portion 7. Namely, the masses of every portion of the club head 1 are balanced and distributed to the peripheral portion of the club head 1 due to the provision of the hollow 12 and the transverse bore 13. Consequently, the production of the moment of inertia is prevented and the sweet spot is widened while attaining a reduction in the weight of the head body 1. The hollow 12 can be formed simultaneously with the formation of the head body 1 by means of a core mold (not shown) integral with the mold and having a configuration identical to that of the hollow 12. On the other hand, the transverse bore 13 can be formed by means of another core mold which is separate from the mold and connected to the core mold mentioned above.

The portion 10*a* of the sole plate 10 adjacent to the face portion, as well as the portion 10*b* of the same adjacent to the back portion, has a substantially sector shape, thereby to distribute the weight of the sole plate 10 to the areas around the face portion 2 and the back portion 7 of the club head 1. By so doing, it is possible to attain a higher balance of the mass in the direction of impact of the ball, i.e., in the direction perpendicular to the face 2, thereby to stabilize the control of the ball-flying direction and the sweet spot.

The hollow 12 and the transverse bore 13 are adapted to be filled with a porous filler such as a foamed material or the like By varying the weight of this filler, it is possible to adjust the weight of the club head body 1. It is also possible to make the transverse bore 13 have a sufficiently large size so that the transverse bore may be filled with a balancer suitable for the user, thereby to increase the mass of the club head while avoiding generation of the moment of inertia.

As has been described, according to the device, the head body of a golf club has a hollow formed in the portion thereof where the sole plate is mounted so as to be covered by the sole plate and a transverse bore extending from the hollow towards the toe portion, the hollow and the transverse bore having irregular configurations so as to provide a balance of masses around the face portion, toe portion, heel portion and the back portion of the head body. Therefore, no moment of inertia is produced when this club head is swung. In addition, since the mass of the head body is distributed in a good manner in the peripheral portion thereof, the sweet spot of the club head body is sufficiently widened to ensure an easy use of the golf club.

Furthermore, the device makes it possible to easily produce a golf club head made of a synthetic resin having characteristics and performance equivalent to those of wooden club heads, i.e., club heads having the same size and shape as those of wooden club heads and equipped with a sole plate, due to a good balance of mass afforded by the hollow.

Intending to claim all novel, useful and unobvious features shown or described, I make the following claims:

1. A golf club driver head comprising:

(a) a club head body made of high density plastic, and having a face portion, a top portion, a sole portion having a step for mounting a sole plate, a toe portion, a heel portion, a back portion and a neck;

(b) said club head body having a cavity extending upwardly from an opening located substantially centrally of said sole portion;

(c) a sole plate mounted at said step and covering said opening of said sole portion, said sole plate having a configuration substantially corresponding to that of said sole portion, except for a narrowed portion substantially midway between the region of the face portion and the region of the back portion;

(d) said club head body having a blind bore devoid of any weighting material extending transversely from the inner end of said cavity and forwardly towards said toe portion;

(e) said bore and cavity together with said centrally narrowed sole plate distributing the weight or mass of said head body to the peripheral portion thereof.

* * * * *